US009706293B2

(12) United States Patent
Wedge

(10) Patent No.: US 9,706,293 B2
(45) Date of Patent: Jul. 11, 2017

(54) MULTI-CHANNEL AUDIO PANEL

(76) Inventor: Donald Scott Wedge, Santa Cruz, CA (US)

( * ) Notice: Subject to any disclaimer, the term of this patent is extended or adjusted under 35 U.S.C. 154(b) by 791 days.

(21) Appl. No.: 13/481,074

(22) Filed: May 25, 2012

(65) Prior Publication Data

US 2012/0275603 A1 Nov. 1, 2012

Related U.S. Application Data

(63) Continuation of application No. 11/759,839, filed on Jun. 7, 2007, now Pat. No. 8,189,827, which is a continuation of application No. 09/320,349, filed on May 26, 1999, now Pat. No. 7,260,231.

(51) Int. Cl.

| | |
|---|---|
| ***H04R 5/00*** | (2006.01) |
| ***H04R 3/00*** | (2006.01) |
| *H04S 1/00* | (2006.01) |
| *H04S 7/00* | (2006.01) |

(52) U.S. Cl.

CPC ..... *H04R 3/00* (2013.01); *H04S 1/002* (2013.01); *H04S 1/005* (2013.01); *H04S 7/304* (2013.01); *H04S 2400/01* (2013.01)

(58) Field of Classification Search

CPC ..... H04S 1/002; H04S 1/005; H04S 1/007; H04S 1/1016; H04S 1/1041; H04S 5/033; H04S 5/04; H04S 7/304; H04S 2400/01; H04S 2420/01; H04S 2420/07

USPC ..... 381/1–18, 309, 310, 86, 56, 77, 79, 110

See application file for complete search history.

(56) References Cited

U.S. PATENT DOCUMENTS

| | | | | |
|---|---|---|---|---|
| 3,848,092 A | | 11/1974 | Shamma | |
| 4,239,939 A | * | 12/1980 | Griffis | 381/17 |
| 4,308,424 A | * | 12/1981 | Bice, Jr. | 381/17 |
| 4,434,508 A | | 2/1984 | Sommer | |
| 4,555,795 A | * | 11/1985 | Bedini | 381/17 |
| 4,817,149 A | | 3/1989 | Myers | |
| 4,841,572 A | * | 6/1989 | Klayman | 381/17 |
| 4,856,064 A | | 8/1989 | Iwamatsu | |
| 4,941,187 A | | 7/1990 | Slater | |
| 5,173,944 A | | 12/1992 | Begault | |
| 5,208,860 A | * | 5/1993 | Lowe et al. | 381/17 |
| 5,333,200 A | | 7/1994 | Cooper et al. | |
| 5,355,416 A | | 10/1994 | Sacks | |
| 5,438,623 A | | 8/1995 | Begault | |
| 5,734,724 A | | 3/1998 | Kinoshita et al. | |
| 5,905,464 A | | 5/1999 | Lanciaux | |

(Continued)

OTHER PUBLICATIONS

See Attachment A (2 pages) Patent No. 7,260,231 (U.S. Appl. No. 09/320,349). Mail Room Date Jun. 19, 2003.

(Continued)

*Primary Examiner* — Xu Mei

(74) *Attorney, Agent, or Firm* — LaRiviere, Grubman PC

(57) ABSTRACT

A method and apparatus for providing improved intelligibility of contemporaneously perceived audio signals. Differentiation cues are added to monaural audio signals to allow a listener to more effectively comprehend information contained in one or more of the signals. In a specific embodiment, a listener wearing stereo headphones listens to simultaneous monaural radio broadcasts from different stations. A differentiation cue is added to at least one of the audio signals from the radio reception to allow the listener to more effectively focus on and differentiate between the broadcasts.

6 Claims, 7 Drawing Sheets

(56) References Cited

U.S. PATENT DOCUMENTS

| | | | | |
|---|---|---|---|---|
| 6,011,851 | A | 1/2000 | Connor et al. | |
| 6,041,127 | A | 3/2000 | Elko | |
| 6,111,958 | A | 8/2000 | Maher | |
| 6,590,983 | B1 * | 7/2003 | Kraemer | 381/17 |
| 7,260,231 | B1 | 8/2007 | Wedge | |
| 8,189,827 | B2 * | 5/2012 | Wedge | 381/310 |

OTHER PUBLICATIONS

See Attachment B (1 page) Patent No. 7,260,231 (U.S. Appl. No. 09/320,349). Mail Room Date Nov. 4, 2005.

Begault et al., "Techniques and Applications for Binaural Sound Manipulation in Human-Machine Interfaces", *NASA Technical Memorandum 102279*, (Aug. 1990).

Begault, "Call Sign Intelligibility Improvement Using a Spatial Auditory Display", *NASA Technical Memorandum 104014*, (Apr. 1993).

Begault et al., "Headphone Localization of Speech", *Human Factors*, 35(2): 361-376 (Jun. 1993).

Begault et al., "Multi-Channel Spatial Auditory Display for Speech Communications", *95th Audio Engineering Society Convention*, Preprint No. 3707, New York Audio Engineering Society (Oct. 7-10, 1993).

Begault, "Call sign intelligibility improvement using a spatial auditory display", *Seventh Annual Workshop on Space Operation and Research* (*SOAR '93*), vol. 2, Houston Texas, Johnson Space Center (Aug. 3-5, 1993).

Begault, *3-D Sound for Virtual Reality and Multimedia*, by Academic Press, Inc., pp. 229-239 (1994).

Bregman et al., *Demonstrations of Auditory Analysis, The perceptual organization of sound*, Dept. of Psychology Auditory Perception Laboratory, McGill University, pp. 66-73.

Bronkhorst et al., "Effect of multiple speechlike maskers on binaural speech recognition in normal and impaired hearing", *J. Acoust. Soc. Am.*, 92: 3132-3139 (Dec. 1992).

Cherry, "Some Experiments on the Recognition of Speech, with One and with Two Ears", *J. Acoustical Soc. of Am.*, 25(5): 975-979 (Sep. 1953).

Cherry et al., "Some Further Experiments upon the Recognition of Speech, with One and with Two Ears", *J. Acoustical Soc. of Am.*, 26(4): 554-559 (Jul. 1954).

Levitt et al., "Binaural Release From Masking for Speech and Gain in Intelligibility", *J. Acoustical Soc. of Am.*, 42(3): 601-608 (1967).

Licklider, "The Influence of Interaural Phase Relations upon the Masking of Speech by White Noise*", *J. Acoustical Soc. of Am.*, 20(2): 150-159 (Mar. 1948).

Pollack et al., "Stereophonic Listening and Speech Intelligibility against Voice Babble*", *J. Acoustical Soc. of Am.*, 30(2): 131-133 (Feb. 1958).

AlliedSignal Aerospace, "Maintenance Manual for the Bendix/King KMA24 Audio Panel/Marker Beacon Receiber" (1996).

Operation Manuel for AA83 InterMUSIC Stereo Intercom, by Nothern Airborne technology, LTD. (Apr. 18, 1994).

Spec Sheets for AA83 InterMUSIC, AMS50 Audio Panel, and AA85 InterVOX II; by Northern Airborne technology, LTD (1998).

Nilsson, J., "Electric Circuits", 1990, Addison-Wesley Publishing Company, Inc. 3rd Ed., pp. 42-43.

* cited by examiner

MULTI-CHANNEL AUDIO PANEL

RELATED APPLICATION

This application is a continuation of pending U.S. patent application Ser. No. 11/759,839, Entitled: "Multi-Channel Audio Panel", filed Jun. 7, 2007, and U.S. patent application Ser. No. 09/320,349, Entitled: "Multi-Channel Audio Panel", filed: May 26, 1999, granted: Aug. 21, 2007, U.S. Pat. No. 7,260,231.

BACKGROUND OF THE INVENTION

The invention relates generally to communications systems and particularly communications systems where a listener concurrently receives information from more than one audio source.

Many situations require real-time transfer of information from an announcer or other source to a listener. Examples include a floor director on a set giving instructions to a studio director, lighting director, cameraman, or so forth, who is concurrently listening to a stage performance, rescue equipment operators who are listening to simultaneous reports from the field, a group of motorcyclists talking to each other through a local radio system, or a pilot listening to air traffic control ("ATC") and a continuous broadcast of weather information while approaching an airport to land.

Signals from the several sources are typically simply summed at a node and provided to a headphone, for example. It can sound like one source seems to be "talking over" the second source, garbling information from one or both of the sources. This can result in the loss of important information, and/or can increase the attention required of the listener, raising his stress level and distracting him from other important tasks, such as looking for other aircraft.

Therefore, it is desirable to provide a system and method for listening to several sources of audio information simultaneously that enhances the comprehension of the listener.

SUMMARY OF THE INVENTION

Differentiation cues can be added to monaural audio signals to improve listener comprehension of the signals when they are simultaneously perceived. In one embodiment, differentiation cues are added to at least two voice signals from at least two radios and presented to a listener through stereo headphones to separate the apparent location of the audio signals in psychoacoustic space. Differentiation cues can allow a listener to perceive a particular voice from among more than one contemporaneous voices. The differentiation cues are not provided to stereophonically recreate a single audio event, but rather to enable the listener to focus on one of multiple simultaneous audio events more easily, and thus understand more of the transmitted information when one channel is speaking over the other. The differentiation cues may also enable a listener to identify a broadcast source, i.e. channel frequency, according to the perceived location or character of the binaural audio signal.

Differentiation cues include panning, differential time delay, differential frequency gain (filtering), phase shifting and differences between voices. For example, if one voice is female and another is male, one voice speaks faster or in a different language, one voice is quieter than the other, one voice sounds farther away than the other, and the like. One or more differentiation cues may be added to one or each of the audio signals. In a particular embodiment, a weather report from a continuous broadcast is separated by an amplitude difference between the right and left ears of about 3 dB, and instructions from an air traffic controller are conversely separated between the right and left ears by about minus 3 dB.

DESCRIPTION OF THE SPECIFIC EMBODIMENTS

The present invention uses differentiation cues to enhance the comprehension of information simultaneously provided from a plurality of monaural sources. In one embodiment, two monaural radio broadcasts are received and demodulated. The audio signals are provided to both sides of a stereo headset, the signal from one channel being louder in one ear than in the other.

Figure 1A:
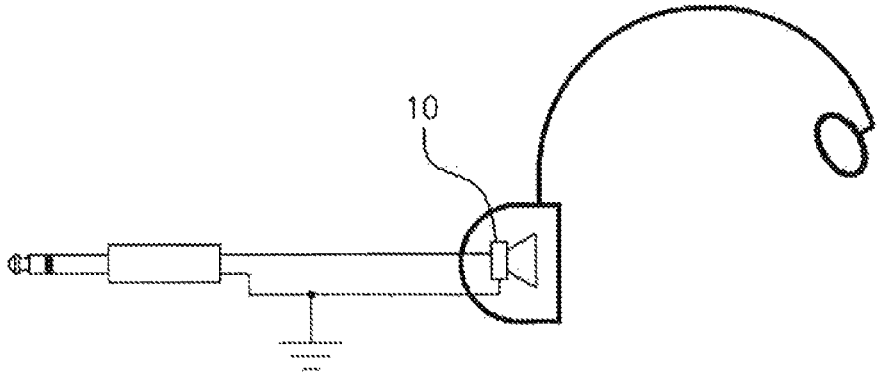
FIG. 1A (PRIOR ART)
FIG. 1A is a simplified representation of a monaural, single transducer headset.
Figure 1B:
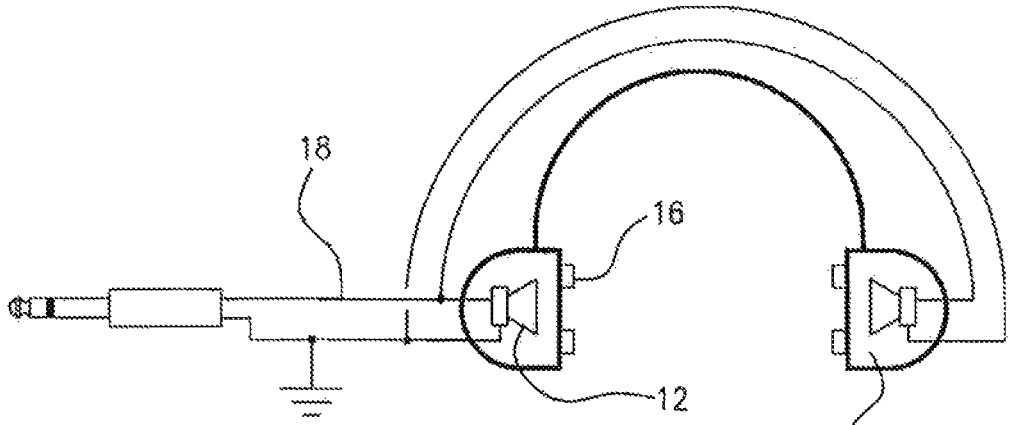
FIG. 1B (PRIOR ART)
FIG. 1B is a simplified representation of a monaural, dual transducer headset.

Stereo headsets are understood to be headsets with two acoustic transducers that can be driven with different voltage waveforms. Stereo headsets are common, but have only recently become widely utilized in light aircraft with the advent of airborne stereo entertainment systems. Early aviation headsets had a single transducer (speaker, or earphone) 10, as shown in FIG. 1A that typically was used to listen to a selected radio transmission. Later, headsets with dual earphones 12, 14, as shown in FIG. 1B, were provided so that the pilot or other listener could use both ears. Because of the background noise in a cockpit or cabin, aviation headsets typically include a seal 16 that fits around the ears and attenuates the background noise. However, both transducers were driven with a single signal, represented by the common drive wire 18. Microphones not shown) are usually included.

Figure 1C:
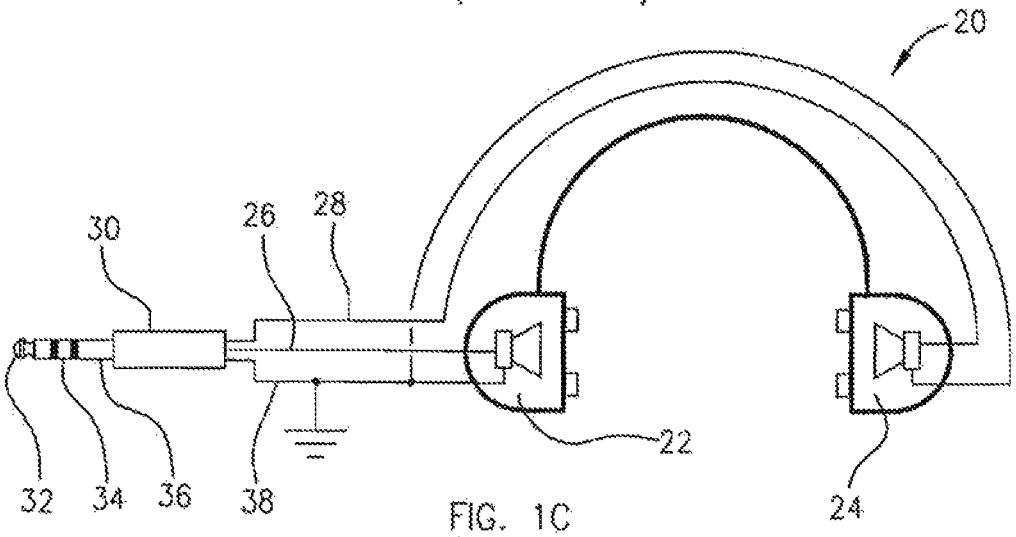
FIG. 1C (PRIOR ART)
FIG. 1C is a simplified representation of a stereo headset.

Fairly recently, stereo headsets for use in airplanes have become available. FIG. 1C shows a stereo headset 20 with dual earphones, commonly labeled right 22 and left 24. It is understood that "left" and "right" are relative terms used merely to simplify the discussion. Each transducer is connected to a separate wire, the left drive wire 26 and the right drive wire 28. A stereo plug 30 provides multiple contacts 32, 34, 36, for the left and right drive wires and a common ground 38. The avionics stereo headsets have recently become available for use with on-board stereo entertainment systems.

As is familiar to those skilled in the art, a stereo entertainment system typically receives a multiplexed signal from a source, such as a stereo tape recording, and de-multiplexes the signal into right and left channels to provide a more realistic listening experience than would be attained with a single-channel system, such as a monaural tape recording. Recording a multiplexed signal and then de-multiplexing the signal provides a more realistic listening experience because the listener can differentiate the apparent location of different sound sources in the recording, and combine them through the hearing process to recreate an original audio event. Typical avionics panels allow a listener to switch between the entertainment system and selected radio receivers without removing his headset. When the listener switches to a desired radio transmission, the contacts 32, 34 of the stereo plug (headset) are fed the same signal, and the stereo headset operates as the dual earphone, monaural headset shown in FIG. 1B. The radio transmissions of interest are typically monaural sources, such as a weather broadcast, or ATC, and there would be no need to broadcast such signals as a stereo broadcast because they typically derive from a single voice.

Figure 2:
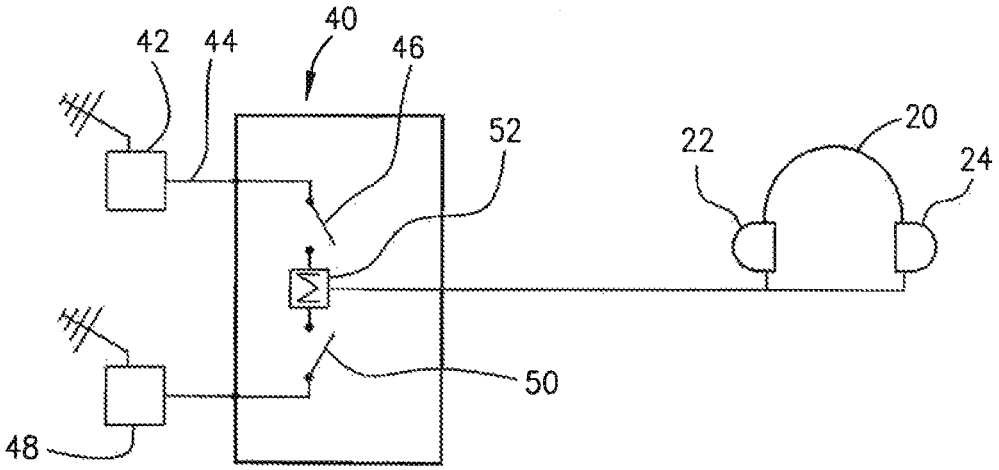
FIG. 2 is a simplified representation of a dual broadcast monaural receiver system for aircraft application.

FIG. 2 is a simplified representation of an audio panel 40 in a light aircraft. The pilot (not shown) wears a headset 20 with two earphones 22, 24, one for each ear. A radio receiver 42 receives a broadcast transmission, which is de-modulated to produce an audio signal, represented by the connection 44 between the receiver 42 and the audio panel 40. The pilot or other listener can select the output from the receiver 42 by closing a switch 46. If the pilot wants to listen to other channels (i.e. other radio signals broadcast on other carrier frequencies), such as from the second radio receiver 48 tuned to a second radio frequency, the pilot can close a second switch 50. If the pilot wants to listen to both broadcast frequencies at once, he can close both switches 46, 50. The audio signals are linear voltage waveforms that may be summed at a summing device 52, such as an amplifier. The sum of the signals is then presented to both earphones 22, 24 of the headset, even if the headset is a stereo headset.

Figure 3:
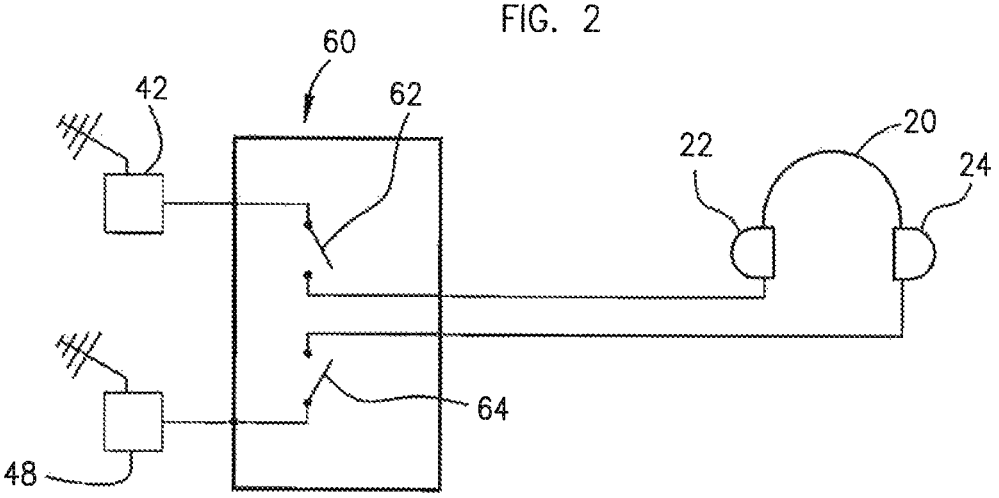
FIG. 3 is a simplified representation of a dual broadcast binaural receiver system according to an embodiment of the invention.

FIG. 3 shows an audio panel 60 according to one embodiment of the present invention. A stereo headset 20 is connected to the audio panel 60 in such a way that the left earphone 22 can be selected by switch 62 to connect with a first radio receiver 42 and the right earphone 24 can be switched to connect with a second radio receiver 48. The first and second radio receivers are tuned to different frequencies and receive different monaural audio broadcasts, the first audio broadcast being heard in the left ear and the second audio broadcast being heard in the right ear.

It was determined that separating audio broadcasts between the right and left ears significantly enhances the retention by the listener of information contained in either or both broadcasts, compared to the prior practice of summing the audio signals and presenting a single voltage waveform to one or both headset transducers. As discussed above, a pilot must often listen to or monitor two radio stations at once. While many pilots have become used to one station talking over another, separating the audio signals significantly reduces pilot stress and workload, and makes listening to two or more audio streams at once almost effortless.

Binaural hearing can provide the listener with the ability to distinguish individual sound sources from within a plurality of sounds. It is believed that hearing comprehension is improved because human hearing has the ability to use various cues to recognize and isolate individual sound sources from one another within a complex or noisy natural sonic environment. For example, when two people speak at once, if one has a higher pitched voice than the other, it is easier to comprehend either or both voices than if their pitch were more similar. Likewise, if one voice is farther away, or behind a barrier, the differences in volume, reverberation, filtering and the like can aid the listener in isolating and recognizing the voices. Isolation cues can also be derived from differences between the sounds at the listener's two ears. These binaural cues may allow the listener to identify the direction of the sound source (localization), but even when the cues are ambiguous as to direction, they can still aid in isolating one sound from other simultaneous sounds. Binaural cues have the advantage that they can be added to a signal without adversely affecting the integrity or intelligibility of the original sounds, and are quite reliable for a variety of sounds. Thus, the ability to understand multiple simultaneous monaural signals can be enhanced by adding to the signals different binaural differentiation cues, i.e., attribute discrepancies between the left and right ear presentations of the sounds.

Panning, or intra-aural amplitude difference (IAD), can provide a useful differentiation cue to implement. In panning techniques, an amplitude of a single signal is set differently in two stereo channels, resulting in the sound being louder in one ear than the other. This amplitude difference can be quantified as a ratio of the two amplitudes expressed in deciBells (dB). Panning, along with time delay, filtering and reverberation differences, can occur when a sound source is located away from the center of the listener's head position, so it is also a lateralization cue. The amplitude difference can be described as a position in the stereo field. Thus, applying multiple different IAD cues can be described as panning each signal to a different position in the stereo field. Since this apparent positioning is something that human hearing can detect, this terminology provides a convenient shorthand to describe the phenomena: It is possible to hear and understand several voices simultaneously when voice signals are placed separately in the stereo field, whereas intelligibility is degraded if the same signals are heard monophonically or at the same stereo position.

Some systems known in the art permit accurate perception of the position of a sound source (spatialization), and those systems use head related transform functions (HRTF) or other functions that utilize a complex combination or amplitude, delay and filtering functions. Such prior art systems often function in a manner specific to a particular individual listener and typically require substantial digital signal processing. If the desired perceived position of the sound source is to change dynamically, such systems must re-calculate the parameters of the transform function and vary in real time without introducing audible artifacts. These systems give strong, precise and movable position perception, but at high cost and complexity. Additionally, costly sensitive equipment may be ill suited, to applications in a rugged environment, such as aviation.

Figure 4:
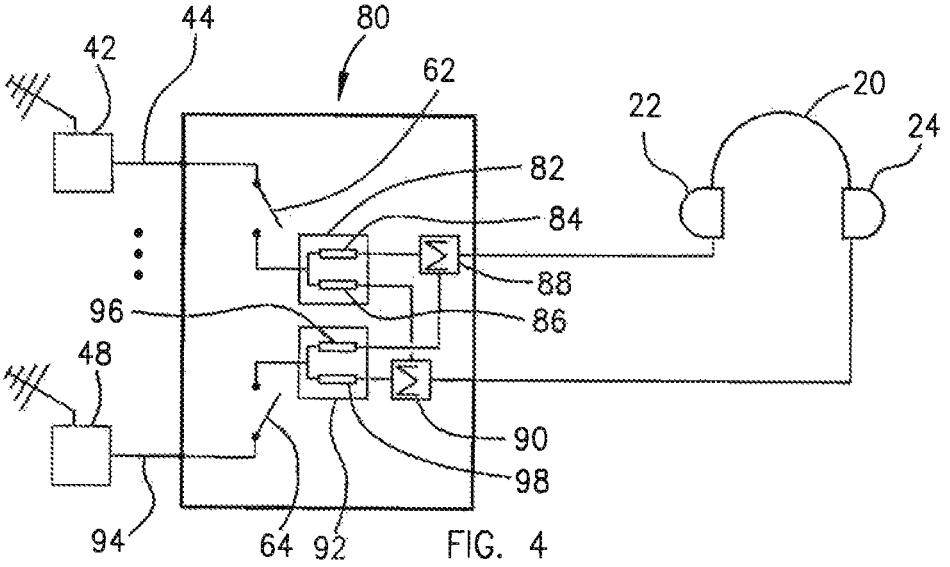
FIG. 4 is a simplified representation of a dual broadcast binaural receiver system according to another embodiment of the invention.

FIG. 4 is a simplified, representation of an avionics audio panel 80 according to another embodiment of the invention. Audio inputs can be from one or more sources, only two of which are shown for simplicity, 42, 48 can be selected with switches 62, 64 to connect the audio input from a source to differentiation function blocks 82, 92. The differentiation function blocks add one or more differentiation cues to the monaural audio inputs 44 and 94 from sources 42, and 48, respectively, and then provide the differentiated outputs to both earphones 22, 24 of a stereo headset 20. In this instance, the differentiation function block 82 provides the monaural audio from source 1 to two process blocks 84, 86; however, one of the process blocks may be a null function (i.e. it passes the audio signal without processing). Similarly, differentiation function block 92 provides the monaural audio from source 2 to two process blocks 96 and 98.

The differentiation function block could be a resistor or resistor bridge, for example, providing differential attenuation between the right and left outputs, or may be a digital signal processor ("DSP") configured according to a program stored in a memory to add a differentiation cue to the audio signal, or other device capable of applying a differentiation function to the monaural audio signal. A DSP may provide phase shift, differential time delay, filtering, and/or other attributes to the right channel relative to the left channel, and/or relative to other differentiated audio signals. The outputs of left summer 88 and right summer 90 are then provided to the left and right earphones 22, 24. Depending on the signals and differentiation processes involved, the summers may be simply a common node, or may provide isolation between process blocks, limit the total power output to the earphone, or provide other functions. While FIG. 4 illustrates two channels, those of ordinary skill in the art can readily appreciate that it is easily extended to accommodate greater numbers of channels. Additionally, the audio panel 80 may have other features, such as a volume control, push to-talk, and intercom functions (not shown).

There are many differentiation cues that can be used to enhance listener comprehension of multiple sounds, including separation (panning), time delay, spectral filtering, and reverberation, for example. A binaural audio panel may provide one or more cues to either or both of a right path and a left path. It is generally desirable to provide the audio signal from each source to both ears so that the listener will hear all the information in each ear. This is desirable if the listener has a hearing problem in one ear, for example. In one instance, 3 dB of amplitude difference between the audio signals to the left and right earphones provided good differentiation cues to improve broadcast comprehension while still allowing a listener with normal hearing to hear both audio signals in both ears. That is, the amplitude of the voltage of an audio signal driving an earphone with a specified impedance was about twice as great as the voltage of the audio signal driving the other earphone having the same nominal impedance.

Figure 5:
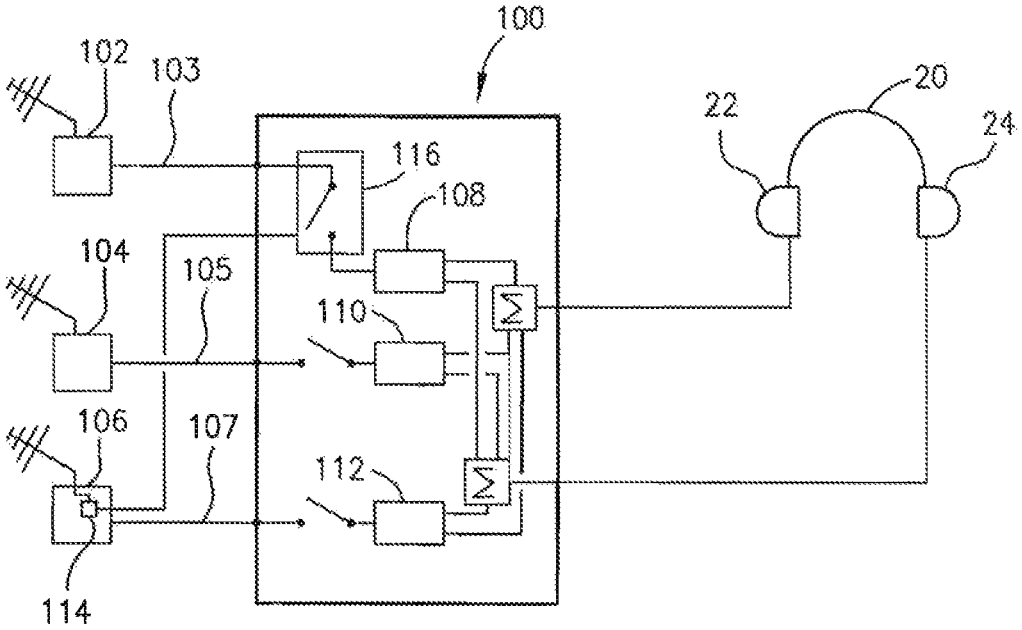
FIG. 5 is a simplified representation of a multi-broadcast binaural receiver system according to an embodiment of the present invention.

FIG. 5 is a simplified representation of a multi-broadcast binaural audio system with several receivers 102, 104, 106. The receivers could be tuned to a weather broadcast, ATC, and a hailing channel respectively, for example. Additional channels may be present, but the example is limited to three for clarity. Differentiation cues are added to each signal by processing the respective audio signals 103, 105, 107 in differentiation blocks 108, 110, 112. Additionally, a signal detector (i.e. carrier detector) 114 or threshold detector (i.e. audio amplitude detector) (not shown) is present on at least one channel, in this example the hailing channel. The detection of a broadcast on that channel automatically de-selects another channel. In this instance, detection of a broadcast on the hailing channel de-selects the weather broadcast by opening a switch 116. The combination of channel de-selection and channel differentiation optimizes listener comprehension of the most critical information. A threshold detector is preferable over a carrier detector on a channel that often broadcasts a carrier-only signal, also known as "dead air", so that the subordinate channel will not be de-selected unless audio information is present on the superior channel.

Figure 6:
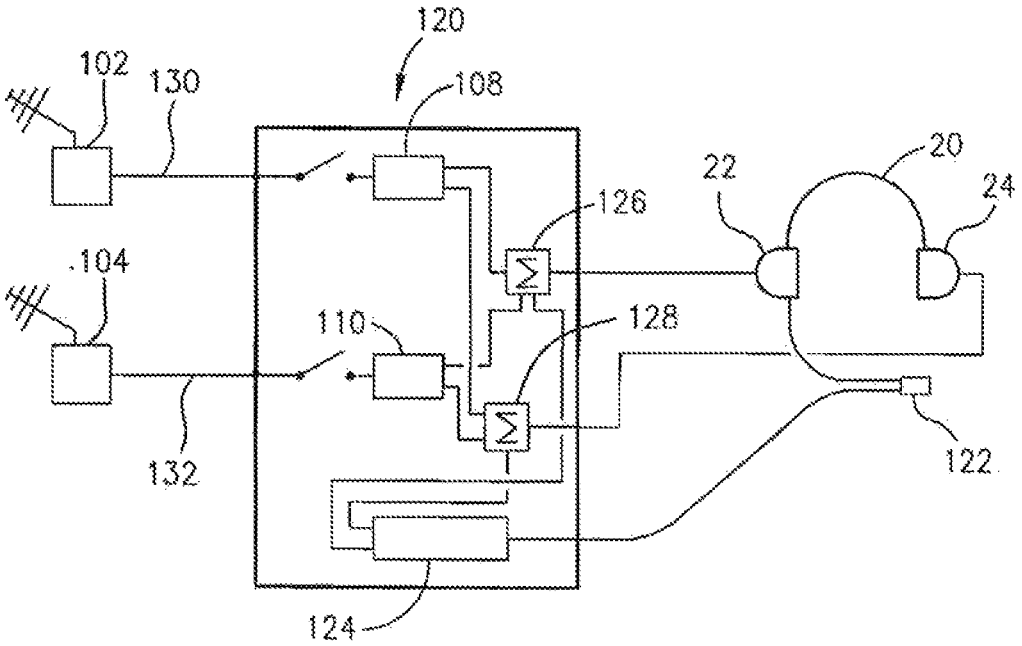
FIG. 6 is a simplified representation of a binaural communications system for use with monaural audio transmissions and monaural microphones.

FIG. 6 is a simplified representation of a binaural communications system 120 for use with a monaural microphone(s) in conjunction with monaural audio transmissions. A microphone 122, such as is used in an intercom system, for example, produces an audio signal that is processed through a differentiation block 124 and provided to left and right summers 126, 128, as are the audio signals 130, 132, from receivers 102, 104. Separating the microphone signals in the stereo mix reduces the interference of the microphone signals from each other and with the radio signals and improves listener comprehension of all signals.

Figure 7A:
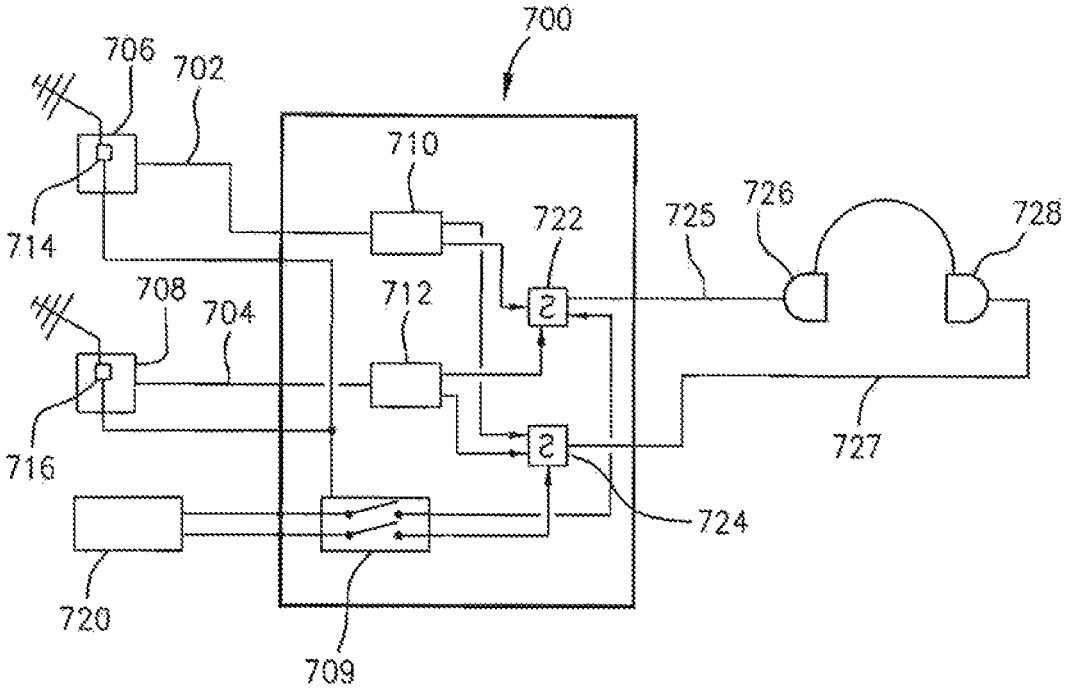
FIG. 7 A is a simplified representation of a combination stereo entertainment communications system.
FIG. 7B is as simplified schematic diagram of a stereo audio panel circuit.
FIG. 7C is a simplified representation of an audio panel with radio receivers, entertainment system, and intercom for multiple listeners, according to another embodiment of the present invention.

FIG. 7 A is a simplified representation of an audio panel 700 that combines a stereo entertainment system and a communications system. Audio signals 702, 704 from radio receivers 706, 708 are given differentiation cues by differentiation blocks 710, 712. The differentiation cues not only improve listener comprehension, but may also allow the listener to identify the source of the monaural broadcast by its position in psychoacoustic space, that is, where the listener perceives the monaural audio signal is coming from. Summers 722, 724, of which several varieties are known in the art, combine signals from the selected sources to produce, for example, a left signal 725 to the left transducer 726 and a right signal 727 to the right transducer 728. Additionally, signal detectors 714, 716 in the receivers 706, 708 switch 709 out the entertainment source 720 when an incoming broadcast is detected. Thus, not only is the listener unencumbered with the entertainment audio signals, but he can also identify which channels is being received by its associated psychoacoustic position. Alternatively, detectors can be placed to detect an audio signal, rather than a carrier signal, for example, to select or mute an audio signal source.

Figure 7B:
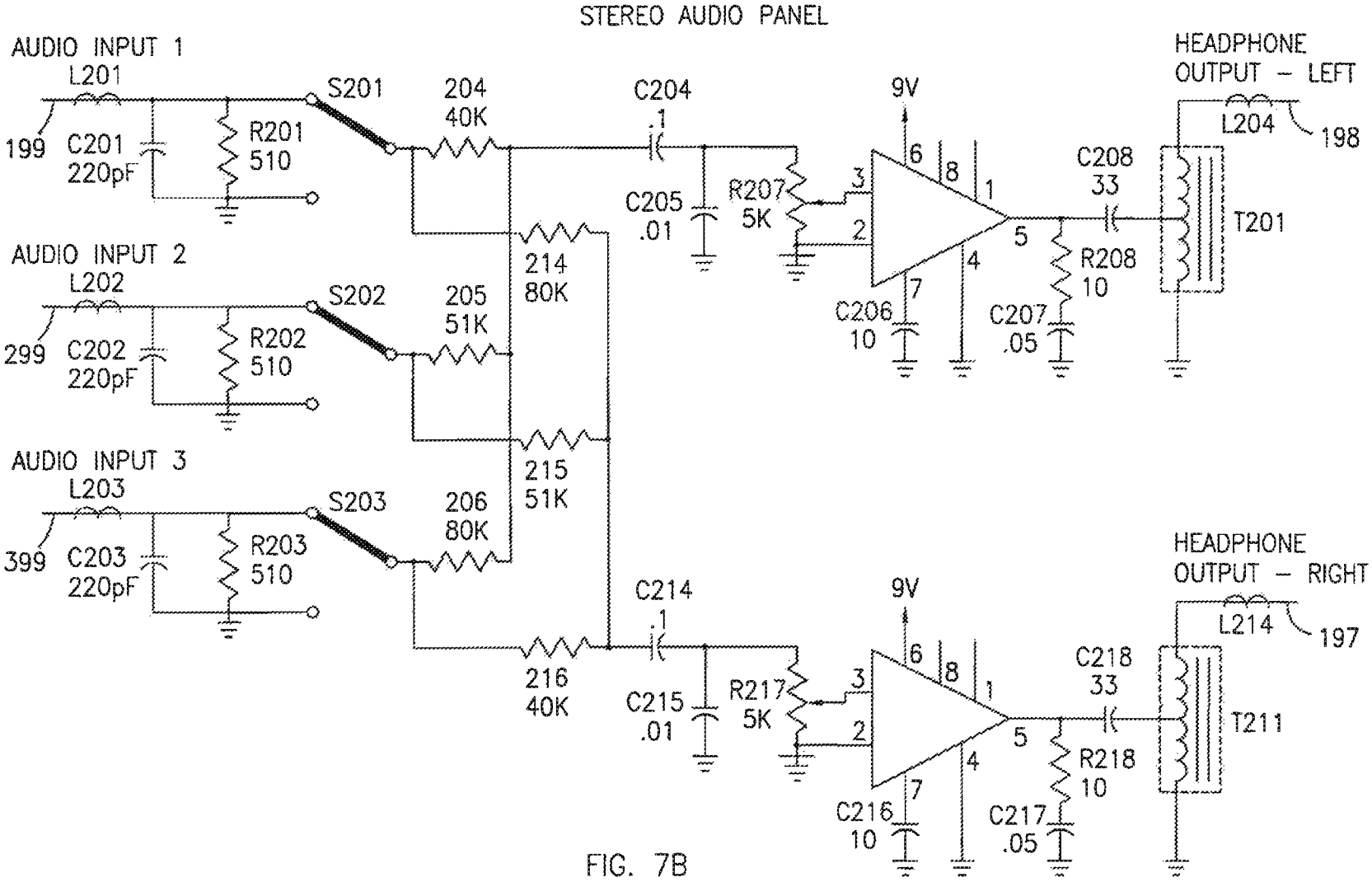

FIG. 7B is a simplified schematic diagram of a stereo audio panel circuit. Resistor pairs 204:214, 205:215, and 206:216 each have a different ratio of values. Thus, Audio Input 1 199 will be louder in the left output 198, Audio Input 2 299 will be equal in both outputs, and Audio Input 3 399 will be louder in the right output 197. In this example, the left/right balance for each signal will allow the listener to distinguish the sounds even when they are present at the same time.

The ratios of values in the resistor pairs are selected to provide about 6 dB of difference between the left and right channels in this example; however, ratios as small as 3 dB substantially improve the differentiability of signals. Ratios larger than about 24 dB lose effective differentiation (i.e., the sound is essentially heard in only one ear). More background sounds/noise require larger ratio differences. Thus, the selection of resistor ratios is application dependent.

It would be possible to put a signal only in one side and not in the other. This has the disadvantage of potentially becoming inaudible if used with a monophonic headphone, a headphone with one non-functioning speaker (transducer), or a listener with hearing in only one ear. By providing at least a reduced level of all inputs to each ear, these potential problems are avoided.

Since stereo position (panning) provides relatively weak differentiation cues, there are limited number of differentiable positions available. Fortunately, however, it is not necessary to provide a unique stereo position to every audio input. For example, there is no reason to listen to multiple navigation radios simultaneously, so the inputs from multiple navigation radios can all share one stereo position.

Also, audio annunciators, such as radar altimeter alert, landing gear, stall warnings, and telephone ringers have distinctive sounds, and so all of these functions can share a stereo position with another signal.

Figure 7C:
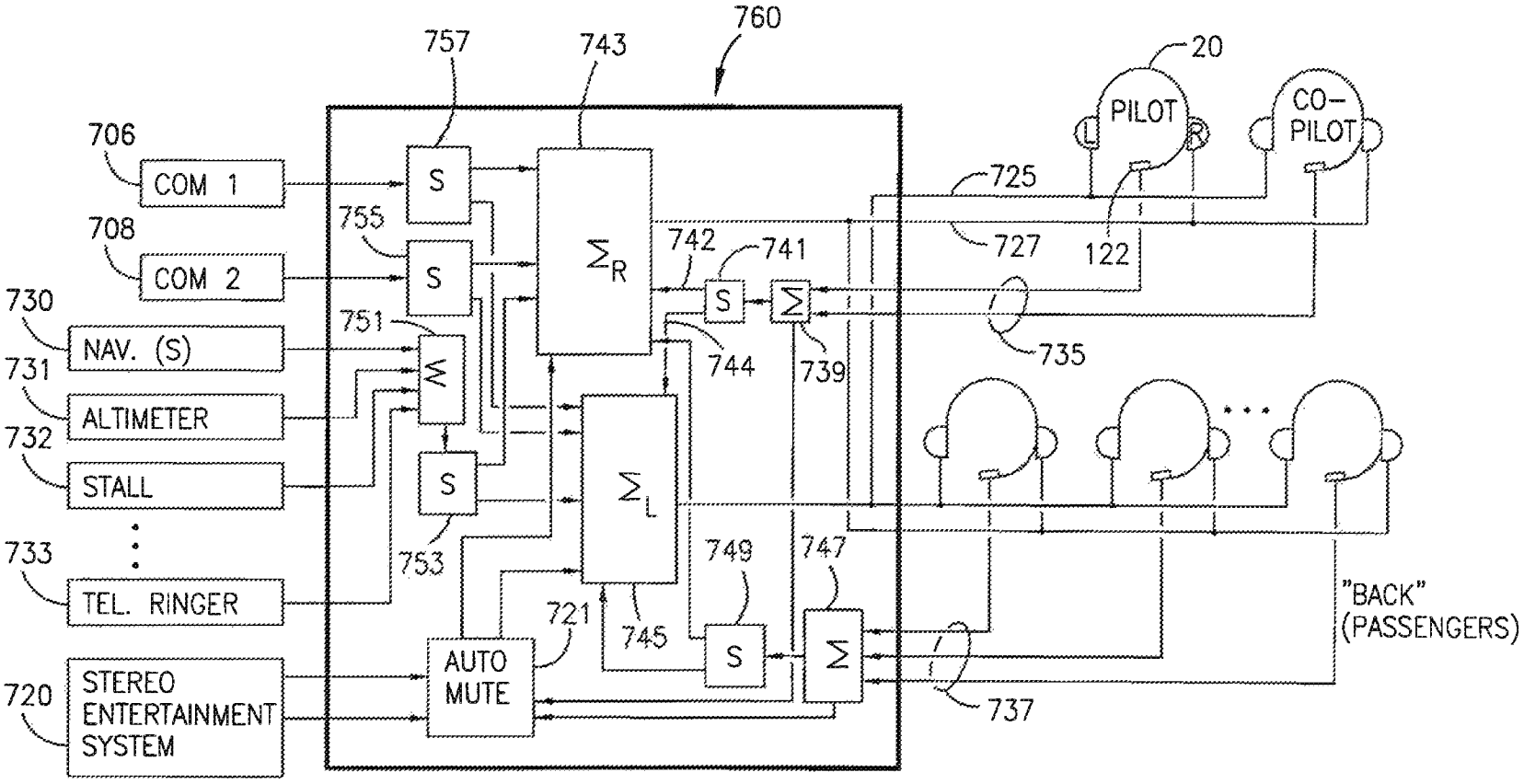

FIG. 7C is a simplified diagram of an audio panel with an intercom system and entertainment system, in addition to radio receivers. An interesting situation exists with an intercom system. An intercom gives each occupant a headphone 20 and microphone 122, usually attached to the headset. The signals from the microphones are added to the audio panel output(s) 725, 727, typically through a VOX circuit (not shown), which keeps the background noise level down, along with signals from an optional entertainment sound source 720, which is a stereo sound source in this example. An entertainment volume mute can be triggered by audio from com and nav sources in this particular example, as well. In order to keep all the sounds straight, the entertainment sound source is automatically muted whenever anyone speaks over the intercom. Intercom users also provide a self muting function by not speaking when another is speaking.

On a long flight, however, passengers often engage in conversations over the intercom and, at least in part, ignore radio calls. One reason this may happen is that many radio calls are heard, but only a few are for the plane carrying the passengers. Also, passengers tend to pay less and less attention as a flight progresses, and they leave the radio monitoring to the pilot. So, it is advantageous to provide a unique stereo position to the intercom microphone signal. All the microphones of the intercom system may be assigned the same differentiation cue because the users can self mute to avoid talking over each other.

In a particular embodiment, five stereo positions are provided:

Com1 706

Com2 708

Nav 730 and annunciators 731, 732, 733 (only some of which are shown for simplicity)

Front Intercom 735, and

Back Intercom 737.

The stereo entertainment system 720 is automatically muted, as discussed above, by an auto-mute circuit 721. The multiple microphone inputs in the front intercom 735 are summed in a summer 739 before a differentiation block 741 adds a first differentiation cue to the summed front intercom and provides right and left channel signals 742, 744 to the right and left summers 743, 745, respectively. Similarly, inputs to the back intercom 737 are summed in a summer 747 before a differentiation block 749 provides a second differentiation cue to the back intercom signal, providing the back intercom signal to the right and left summers 743, 745, as above. The navigation/annunciator inputs are similarly summed in a summer 751 before a differentiation block 753 adds a third differentiation cue before providing these signals to the right and left summers. Com1 706 and Com2 708 are given unique "positions" and are not summed with other inputs. The differentiation blocks 755, 757 provide fourth and fifth differentiation cues. It is understood that the differentiation cues are different and create the impression that the sounds associated with each differentiation cue is originating from a unique psychoacoustic location when heard by someone wearing a stereo headphone plugged into the audio panel 760. The outputs from the stereo entertainment system 720 do not receive differentiation cues.

In some embodiments, sub-channel summers 739 and 747 can be omitted. Instead, each microphone can have an associated resistor pair in which similar values for the front microphones are used, placing the sounds from these microphones in the same psychoacoustic position. A similar arrangement can be used for the back microphones and nav inputs. In this embodiment, two summers can be used, one for the left channel and one for the right channel.

In addition to stereo separation, stronger differentiation cues, such as differential time delay or differential filtering, or combinations thereof, could supply more differentiable positions and hence require less position sharing. In this embodiment, the differentiation cue for Com1 is 6 dB, and for Com2 is minus 6 dB, while the left and right intercom cues are plus and minus 12 dB ratio, for example. The differentiation cue for the navigation/annunciator signal is a null cue, so that these signals are heard essentially equally in each ear. These differentiation cues provide adequate minimum signal levels to avoid problems when used with monophonic headsets. It is possible to separate the intercom functions from the audio panel, and provide inputs from the intercoms to the audio panel, as well as to provide inputs from the audio panel to the intercoms.

It is understood that the amount of separation and the resistor values used to achieve that separation is given only as an example, and that different amounts of separation may be used, or different resistor values may be used to achieve the same degree of separation. In the example shown in FIG. 7B, the resistor pairs are chosen to provide equal total left and right power outputs for each of the three inputs. However, since the level of the signal supplied to each of the inputs is typically adjustable at the source, this aspect of the resistor values is not critical. Adjusting the gain of the circuit would be done using the center channel, Audio Input 2 299, and adjusting both outputs to unity gain.

Figure 8:
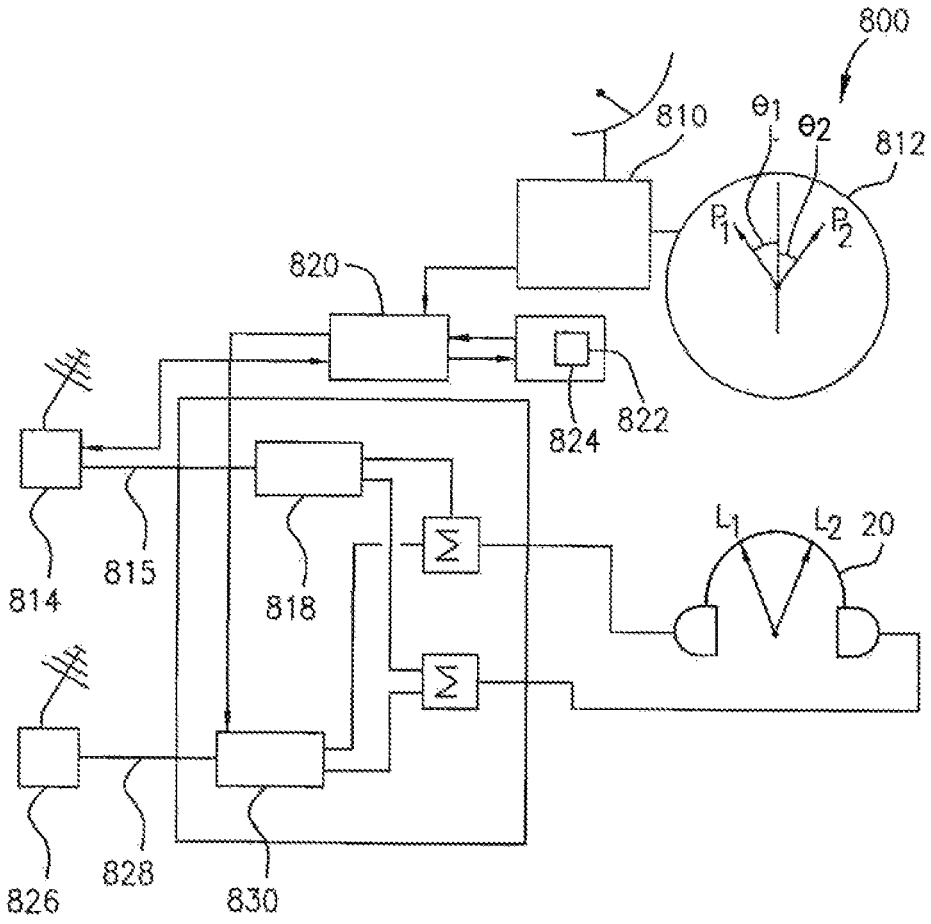
FIG. 8 is a simplified representation of an audio panel for use with airtraffic control.

FIG. 8 is a simplified representation of an audio identification system 800. A location detector 810, such as a radar, identifies the position P1 of an aircraft (not shown), and indicates that position on a display 812. The position on the display indicates a position of the aircraft relative to an operator (not shown). The operator has a stereo headset 20 and associates a channel frequency with the aircraft, e.g. a channel is assigned by ATC, or the aircraft designates which channel it will be broadcasting on and tunes a radio receiver 814 to that channel. A processor 820 then automatically determines the proper differentiation cues to add to the audio signal 816 from the receiver 814 in the differentiation block 818 according to a computer program 822 stored in a computer-readable memory 824 coupled to the processor 820 in conjunction with the position P1 of the aircraft established by the location detector 810. The differentiation cues may be fixed, or may be automatically updated according to a new position of the aircraft determined by the location detector. For example, the processor may receive an approach angle 01 of an aircraft from the location detector, and then apply the proper panning to the audio signal 816 from the receiver 814 tuned to that aircraft's position so that the psychoacoustic location, represented by L1 of that aircraft is consistent with the aircraft's approach angle 01. Additional differentiation cues may be added to provide additional dimensions to the positioning of the audio signal, as by adding reverberation, differential (right-left) time delays, and/or tone differences to add "height" or other perceived aural information to the audio signal that allow the listener to further differentiate one audio source from another in psychoacoustic space. A similar process may be applied to another aircraft with a second position P2 on the display 810 having a second approach angle 82 that the processor 820 uses in accordance with the program 822 to generate a second psychoacoustic location, represented by L2. Thus, the operator/listener can associate an audio broadcast from one of a plurality of transmission sources according to the differentiation cues added to the monaural audio signal from that source.

Additionally, the listener will be able to listen to and retain more information from one or a plurality of simultaneously heard monaural audio signals because the signals are artificially separated from one another in psychoacoustic space. In some instances, discrete transmission frequencies can be identified with radar locations, for example. In other instances, for example, when several planes are broadcasting on the same frequency, a radio direction finder may be used to associate a broadcast with a particular plane. In either instance, a non-locatable transmission source may indicate that a plane or other transmission source is not showing up on radar. In some instances it may be desirable to use three-dimensional differentiation techniques to provide channel separation or synthetic location. Stereo channel separation is the relative volume difference of the same sound as presented to the two ears.

While the above embodiments completely describe the present invention, other equivalent or alternative embodiments may become apparent to those skilled in the art. For example, differentiation techniques could be used in a local wire or wireless intercom system, such as might be used by a motorcycle club, TV production crew, or sport coaching staff, to distinguish the individual speakers according to acoustic location. As above, not only could the speaker be identified by their psychoacoustic location, the listener would also be able to understand more information if several speakers were talking at once. Similarly, while the invention has been described in terms of stereo headsets, multiple speakers or other acoustic transducer arrays could be used.

Accordingly, the present invention should not be limited by the examples given above, but should be interpreted in light of the following claims.

What is claimed is:

1. Method for electronically modifying intelligibility of multipurpose voices speaking simultaneously comprising the steps of:

receiving a plurality of monophonic audio signals, each of said audio signals having at least one speaking voice;

processing a first of one of the monophonic signals to generate a first stereophonic pair of audio signals, by modifying the first one of the processed monophonic signals electronically, such that a first differentiation cue is applied to the first processed monophonic signal to modify the first stereophonic pair of audio signals, and processing a second one of the monophonic signals to generate a second stereophonic pair of audio signals such that a second differentiation cue is applied to the second one of the processed monophonic signals to modify the stereophonic pair of audio signals; and simultaneously transmitting the first and second stereophonic pairs of audio signals to an audio receiver, whereby intelligibility of said at least one speaking voice is thereby modified when generated via said first and second processed stereophonic pair of audio signals.

2. The method of claim 1 wherein the first and second differentiation cues are different, and comprise audio amplitude, time delay, frequency filtering, or reverberation.

3. Wireless communication system for electronically modifying intelligibility of multiple voices speaking simultaneously comprising:

a first transmitter that wirelessly transmits via at least one communication channel to at least one communication device a plurality of monophonic audio signals, each of said audio signals having at least one speaking voice;

a processor that processes a first one of the monophonic signals to generate a first stereophonic pair of audio signals, by modifying the first one of the processed monophonic signals electronically, such that a first differentiation cue is applied to the first processed monophonic signal to modify the first stereophonic pair of audio signals, and process a second one of the monophonic signals to generate a second stereophonic pair of audio signals such that a second differentiation cue is applied to the second one of the processed monophonic signals to modify the second stereophonic pair of audio signals; and a second transmitter to simultaneously transmit the first and second stereophonic pairs of audio signal and whereby intelligibility of said at least one speaking voice is thereby modified when generated via said first and second processed stereophonic pair of audio signals.

4. The system of claim 3 wherein the first and second differentiation cues are different, and comprise audio amplitude, time delay, frequency filtering, or reverberation.

5. Apparatus for electronically modifying intelligibility of multipurpose voices speaking simultaneously comprising:

means for receiving a plurality of monophonic audio signals, each of aid audio signals having at least one speaking voice;

means for processing a first of one of the monophonic signals to generate a first stereophonic pair of audio signals, by modifying the first one of the processed monophonic signals electronically, such that a first differentiation cue is applied to the first processed monophonic signal to modify the first stereophonic pair of audio signals, and for processing a second one of the monophonic signals to generate a second stereophonic pair of audio signals such that a second differentiation cue is applied to the second one of the processed monophonic signals to modify the stereophonic pair of audio signals; and means for simultaneously transmitting the first and second stereophonic pairs of audio signals to an audio receiver, whereby intelligibility of said at least one speaking voice is thereby modified when generated via said first and second processed stereophonic pair of audio signals.

6. The apparatus of claim 5 wherein the first and second differentiation cues are different, and comprise audio amplitude, time delay, frequency filtering, or reverberation.

* * * * *